US006802104B1

(12) United States Patent
Redd

(10) Patent No.: US 6,802,104 B1
(45) Date of Patent: Oct. 12, 2004

(54) VACUUM HOSE ATTACHMENT

(76) Inventor: Katherine B. Redd, 138 Kevin Dale Dr., Lexington, NC (US) 27295

( * ) Notice: Subject to any disclaimer, the term of this patent is extended or adjusted under 35 U.S.C. 154(b) by 324 days.

(21) Appl. No.: 10/114,617

(22) Filed: Apr. 2, 2002

(51) Int. Cl.[7] ..... A47L 9/06
(52) U.S. Cl. ..... 15/393; 15/415.1
(58) Field of Search ..... 15/393, 394, 395, 15/398, 399, 403, 415.1

(56) References Cited

U.S. PATENT DOCUMENTS

| | | | | | |
|---|---|---|---|---|---|
| 2,214,989 | A | * | 9/1940 | Brand | 15/399 |
| 4,227,278 | A | * | 10/1980 | Raskin et al. | 15/234 |
| 4,972,541 | A | * | 11/1990 | Smith, Jr. | 15/105 |
| 5,074,008 | A | | 12/1991 | Palomino, Jr. | |
| 5,123,142 | A | * | 6/1992 | Miller | 15/393 |
| 5,452,493 | A | | 9/1995 | Galindo | |
| 6,058,560 | A | | 5/2000 | Gab et al. | |
| 6,370,731 | B1 | * | 4/2002 | Carter | 15/393 |
| 2001/0002499 | A1 | | 6/2001 | Linquist et al. | |
| 2001/0010106 | A1 | | 8/2001 | Lenaghan | |
| 2001/0044980 | A1 | | 11/2001 | Duplesis | |
| 2003/0172491 | A1 | * | 9/2003 | Scott | 15/415.1 |

FOREIGN PATENT DOCUMENTS

| | | | |
|---|---|---|---|
| DE | 3528340 | * | 2/1987 |
| EP | 1 304 067 | * | 4/2003 |
| JP | 8-24175 | * | 1/1996 |
| JP | 10-113315 | * | 5/1998 |

* cited by examiner

*Primary Examiner*—Terrence R. Till

(57) ABSTRACT

An attachment for a vacuum cleaner hose allows dusting and debris removal from small, fragile articles such as glasses, china, figurines, plants and the like that are often displayed on open shelves. The attachment includes soft natural feathers which extend therefrom that can contact the objects without damage or displacement thereto. In the preferred form of the invention the attachment has a large conically shaped suction fitting and a smaller conically shaped fitting insert axially aligned therewith, both of which have natural ostrich feathers for safely disturbing and removing dust from and between delicate objects.

16 Claims, 3 Drawing Sheets

VACUUM HOSE ATTACHMENT

FIELD OF THE INVENTION

The invention herein pertains to household vacuum cleaners and in particular pertains to an attachment for placement on the end of a vacuum cleaner hose for dusting and cleaning fragile objects.

DESCRIPTION OF THE PRIOR ART AND OBJECTIVES OF THE INVENTION

Electric vacuum cleaners with extending hoses have long been used for cleaning floors and other areas. The flexible hose normally has a stiff metal or plastic tubular distal end for connection to various implements, some of which have relatively stiff bristles. Other types of implements or attachments are available for use on chairs, draperies and other furnishings.

Many homes display china, photographs, figurines, coins, jewelry, plants and other delicate and fragile objects, such objects being difficult to conveniently dust and clean. It is usual to manually lift each object, dust it individually with a hand duster or cloth and replace it on the shelf. Individual dusting of these objects can be very time-consuming, depending on the number which must be handled carefully. Cleaning personnel often are not careful when replacing such displayed items, requiring the owner to spend time rearranging the displays. Occasionally, an accident will happen and for example, an expensive figurine will be dropped and destroyed in the dusting and cleaning process. A limited number of vacuum hose attachments are often used but with limited success due to the extreme care needed when small, fragile objects are dusted.

Thus, based on the problems and disadvantages of using conventional vacuum hose attachments, the present invention was conceived and one of its objectives is to provide a dusting attachment for a vacuum hose which can be used on and around fragile objects for safe, thorough dust removal.

It is yet another objective of the present invention to provide an attachment for a vacuum cleaner hose which includes a plurality of soft feathers which will not damage, displace or mar fragile, small objects.

It is still another objective of the present invention to provide a vacuum hose attachment which is substantially, conically shaped.

It is yet another objective of the present invention to provide an attachment for a vacuum hose which includes a conically shaped suction fitting having a first plurality of feathers therearound and a fitting insert affixed in axial alignment thereto which likewise is surrounded with feathers.

Other objectives and advantages of the present invention will become apparent to those skilled in the art as a more detailed description is set forth below.

SUMMARY OF THE INVENTION

The aforesaid and other objectives are realized by providing an attachment for a conventional vacuum cleaner hose which will facilitate cleaning of fragile displayed objects such as china, figurines, plants and the like. The attachment in its preferred form includes a conically shaped suction fitting which defines a mouth having a plurality of ostrich feathers affixed thereto. A smaller conically shaped fitting insert is positioned within and axially aligned with the suction fitting. The fitting insert likewise has a plurality of soft feathers surrounding its mouth. The fitting insert is axially aligned but spaced from the suction fitting by a perforated tubular connector. A trap attached to the perforated connector allows for collection of small, lightweight items that may be inadvertently drawn into the fitting insert.

The attachment is joined to the distal end of a conventional vacuum cleaner hose and with the vacuum cleaner operating, the attachment is then manipulated by hand along a display shelf or the like which contains small, delicate objects. The feathers disturb the dust on the objects and surrounding areas to allow the vacuum to draw the dust into the attachment where the dust particles then pass into the hose to the vacuum cleaner debris reservoir. The feathers employed are soft and flexible and the suction fitting and fitting insert are also both formed of flexible materials to prevent damage or displacement of the objects during dusting and cleaning.

DETAILED DESCRIPTION OF THE PREFERRED EMBODIMENT AND OPERATION OF THE INVENTION

Figure 1:
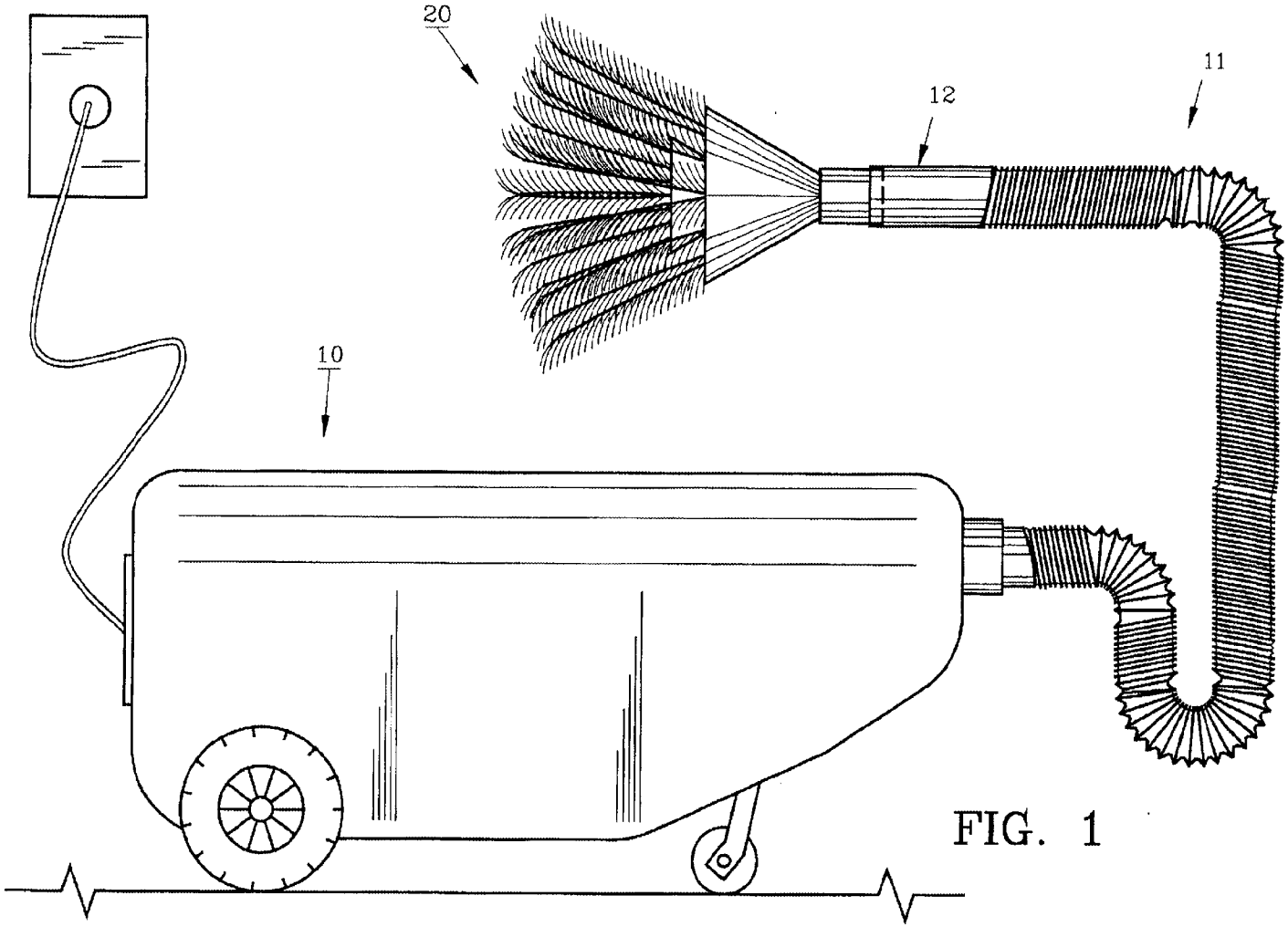
FIG. 1 illustrates a conventional electric household vacuum cleaner having a vacuum cleaner hose, with the attachment of the invention on the distal hose end.
Figure 2:
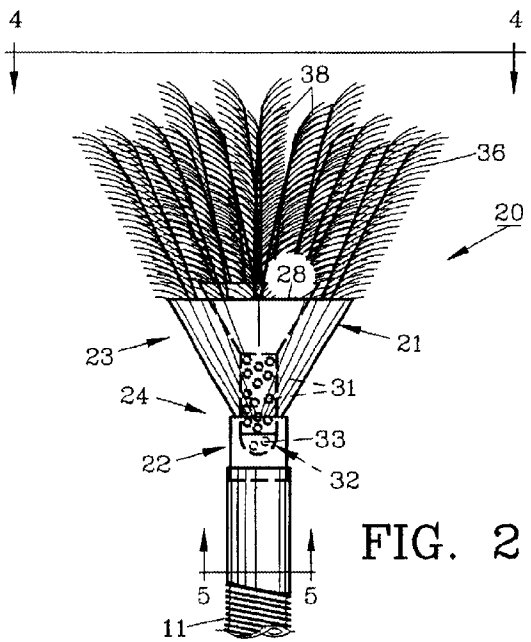
FIG. 2 shows a side elevational view of the preferred form of the attachment on the vacuum hose.
Figure 3:
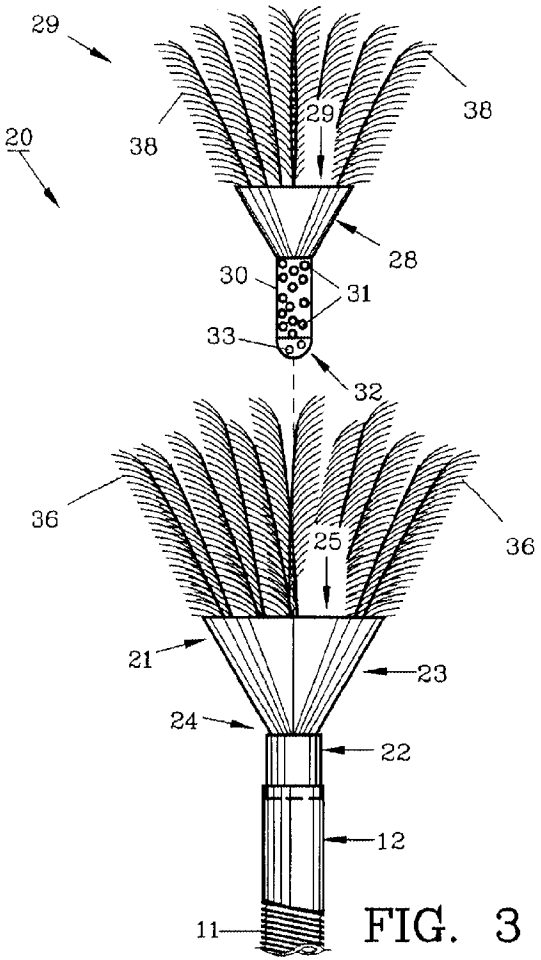
FIG. 3 demonstrates the attachment as shown in FIG. 2 with the fitting insert exploded therefrom.
Figure 5:
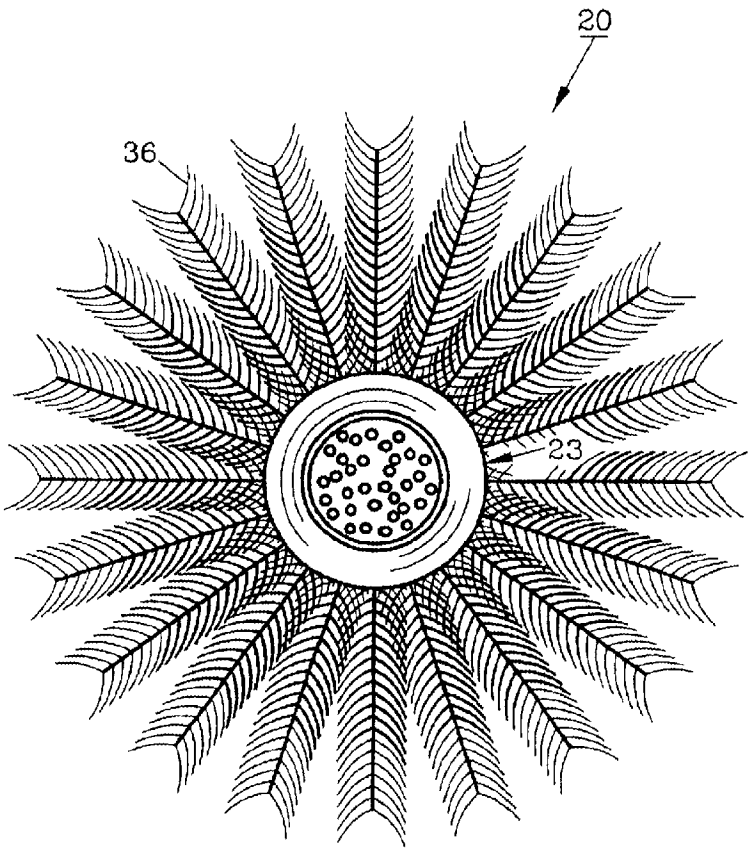
FIG. 5 features a bottom plan view thereof generally along lines 5—5 of FIG. 2 but without the vacuum cleaner hose.
Figure 4:
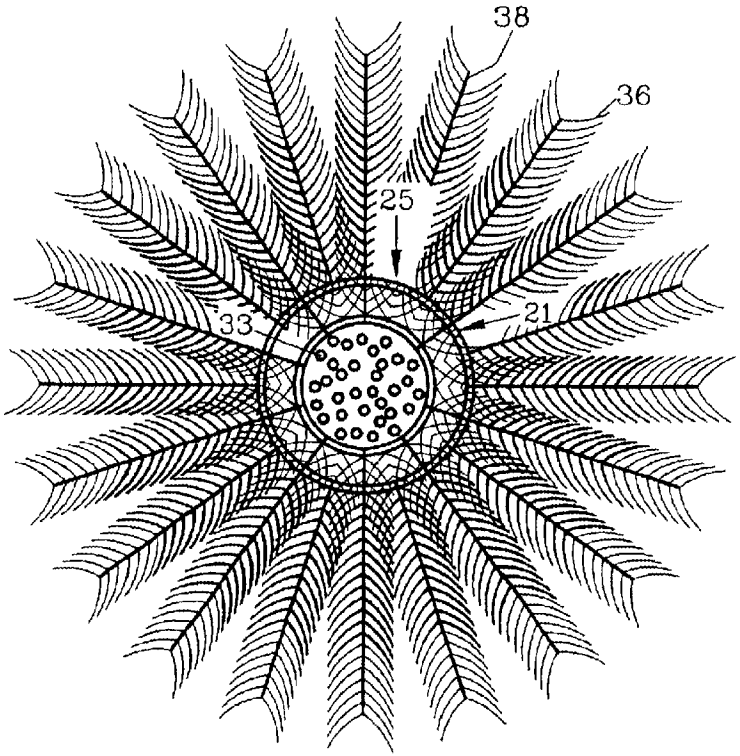
FIG. 4 depicts a top plan view of the attachment as shown in FIG. 2 along lines 4—4.

For a better understanding of the invention and its operation, turning now to the drawings, FIG. 1 shows conventional electric household vacuum cleaner 10 with standard vacuum cleaner hose 11 having metal distal end 12 into which preferred attachment 20 has been inserted for use in cleaning items displayed on, for example, a shelf (not shown) such as china, jewelry and the like. In FIG. 2, a side view of preferred attachment 20 is shown which includes suction fitting 21 having a continuous, conical non-permeable surface formed from a lightweight, flexible, deformable plastic or the like. Tubular member 22 is formed from a substantially rigid polymeric material and is preferably heat-welded to suction fitting 21. Conically shaped suction fitting 21 has a large diameter end 23 and a small diameter end 24 as seen in FIGS. 2 and 3. Large diameter end 23 defines a large open mouth 25 as shown in FIGS. 3 and 4 which is in communication with vacuum hose 11. Fitting insert 28 is also conically shaped as shown in FIG. 3 but has a smaller diameter mouth 29 than does suction fitting 21. Fitting insert 28 is in axial alignment with suction fitting 21 as shown in FIG. 3, and is attached by preferably frictional engagement to suction fitting 21 by perforated connector 30. Perforated connector 30 is formed from a rigid polymeric material, is cylindrically shaped and includes a series of apertures 31 which allows collected dust particles and debris to pass through suction fitting 21 after entering mouth 25 to hose 11. Trap 32 is joined to the end of perforated connector 30, preferably by integrally molding and includes a series of apertures 33 as shown in FIG. 5 to collect any small, lightweight items such as an earring inadvertently passing therein.

As further shown in FIGS. 3 and 4, suction fitting 21 includes mouth 25 surrounded by, preferably ostrich feathers 36. Suction fitting 21 has a diameter of approximately 4" (10.16 cm) with ostrich feathers 36 having a length of approximately 6" (15.24 cm) as extending from mouth 25. Insert fitting 28 has a smaller diameter of approximately 2½" (6.35 cm) with ostrich feathers 38 affixed thereto and extending approximately 4"(10.16 cm) therefrom.

As seen in FIG. 2, fitting insert 28 extends beyond suction fitting 21 approximately 1" (2.54 cm) and feathers 38 are spaced from feathers 36 approximately 0.5" (1.25 cm), depending on the flexibility and specific angle particular conical configuration of suction fitting 21 and insert fitting 28. While feathers 36 and 38 are preferably natural ostrich feathers, other types of natural feathers or even synthetic substitutions thereof may be utilized as desired.

When using attachment 20, insert fitting 28 may be removed and suction fitting 21 with feathers 36 used alone however, trap 32 preferably remains in place as seen in FIG. 2 but such is usually not desirable. In use, tubular member 22 is inserted into metal end 12 of vacuum cleaner hose 11. Then with vacuum cleaner 10 operating, feathers 36 are used to manually brush and gently disturb dust from selected objects while said dust is drawn through vacuum hose 11. For more intense, thorough cleaning, fitting insert 28 with perforated connector 30 is affixed to suction fitting 21 as seen in FIG. 2 and increased dusting capability is provided.

The illustrations and examples provided herein are for explanatory purposes and are not intended to limit the scope of the appended claims.

I claim:

1. An attachment for a vacuum cleaner hose comprising: a suction fitting, said fitting defining a mouth, a first plurality of feathers, said first plurality of feathers encircling said mouth, a second plurality of feathers, said second plurality of feathers concentric to said first plurality of feathers.

2. The attachment of claim 1 wherein said suction fitting is conically shaped.

3. The attachment of claim 1 wherein said suction fitting has a large diameter end and a small diameter end, said small diameter end attached to said vacuum cleaner hose.

4. The attachment of claim 3 wherein said first plurality of feathers encircles said large diameter end of said suction fitting.

5. The attachment of claim 1 further comprising a fitting insert, said fitting insert frictionally and removably attached to and in axial alignment with said suction fitting.

6. The attachment of claim 5 wherein said second plurality of feathers is attached to said fitting insert.

7. The attachment of claim 5 further comprising a perforated connector, said perforated connector joined to said fitting insert and to said suction fitting.

8. The attachment of claim 7 further comprising a trap, said trap joined to said perforated connector.

9. The attachment of claim 5 wherein said fitting insert is flexible.

10. The attachment of claim 1 wherein said suction fitting is flexible.

11. The attachment of claim 11 wherein said plurality of feathers comprise natural feathers.

12. The attachment of claim 11 wherein said natural feathers comprise ostrich feathers.

13. The attachment of claim 1 wherein said feathers of said first plurality are longer than said feathers of said second plurality.

14. An attachment for the distal end of a vacuum cleaner hose for removing dust from fragile items comprising: a suction fitting, said suction fitting defining a mouth, a first plurality of feathers, said first plurality of feathers encircling said mouth, a fitting insert, said fitting insert joined to said suction fitting, a second plurality of feathers, said second plurality of feathers attached to said fitting insert.

15. The attachment of claim 14 wherein said suction fitting is conically shaped.

16. The attachment of claim 14 wherein said fitting insert is conically shaped.

* * * * *